US009332790B2

(12) United States Patent
Vercollone

(10) Patent No.: US 9,332,790 B2
(45) Date of Patent: May 10, 2016

(54) ATHLETIC GARMENT ASSEMBLY

(71) Applicant: Christian Vercollone, Bridgewater, NJ (US)

(72) Inventor: Christian Vercollone, Bridgewater, NJ (US)

( * ) Notice: Subject to any disclaimer, the term of this patent is extended or adjusted under 35 U.S.C. 154(b) by 0 days.

(21) Appl. No.: 14/504,671

(22) Filed: Oct. 2, 2014

(65) Prior Publication Data

US 2016/0095358 A1 Apr. 7, 2016

(51) Int. Cl.
*A41D 1/08* (2006.01)
*A41D 1/06* (2006.01)

(52) U.S. Cl.
CPC *A41D 1/082* (2013.01); *A41D 1/06* (2013.01); *A41D 2400/10* (2013.01)

(58) Field of Classification Search
CPC ..... A41D 1/06; A41D 1/10; A41D 13/02
USPC ..... 2/227, 231, 232, 79, 269
See application file for complete search history.

(56) References Cited

U.S. PATENT DOCUMENTS 189,883 A * 4/1877 Thompson ..... A41D 1/06 2/227
1,143,282 A * 6/1915 King ..... A41D 10/00 2/227
1,652,750 A * 12/1927 Wohlgemuth ..... A41D 13/0002 2/210
2,216,852 A * 10/1940 McMeekin ..... A41D 1/06 2/227
3,671,975 A 6/1972 Vorsteher
3,733,615 A 5/1973 Jaffee
3,758,890 A 9/1973 Selzer
D289,222 S 4/1987 Maejima
5,134,726 A * 8/1992 Ross ..... A41D 1/08 2/22
6,141,802 A * 11/2000 Drake ..... A41D 1/08 2/22
6,286,150 B1 9/2001 Miller et al.
7,404,215 B2 7/2008 Allen
7,757,305 B2 * 7/2010 Toso ..... A41D 13/0007 2/79
7,836,524 B2 * 11/2010 Muench ..... A41D 1/086 2/227
8,544,114 B2 * 10/2013 Williams ..... A41D 13/0015 2/227
2012/0185998 A1 7/2012 Hagen
2013/0247276 A1 9/2013 Maruji et al.

* cited by examiner

*Primary Examiner* — Tejash Patel

(57) ABSTRACT

An athletic garment assembly for allowing access to bindings on a boot while preventing moisture from entering the boot includes a pair of pants structured to be worn by the user so the pants do not extend low enough to cover a pair of boots worn by the user. A pair of inserts is coupled to the pants. Each of the pair of inserts extends down from the pants and is positioned within a respective one of the pair of boots when the user wears the pants.

5 Claims, 3 Drawing Sheets

ATHLETIC GARMENT ASSEMBLY

BACKGROUND OF THE DISCLOSURE

Field of the Disclosure

The disclosure relates to garment devices and more particularly pertains to a new garment device for allowing access to bindings on a boot.

SUMMARY OF THE DISCLOSURE

An embodiment of the disclosure meets the needs presented above by generally comprising a pair of pants structured to be worn by the user so the pants do not extend low enough to cover a pair of boots worn by the user. A pair of inserts is removably coupled to the pants. Each of the pair of inserts extends down from the pants and is positioned within the pair of boots when the user wears the pants.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
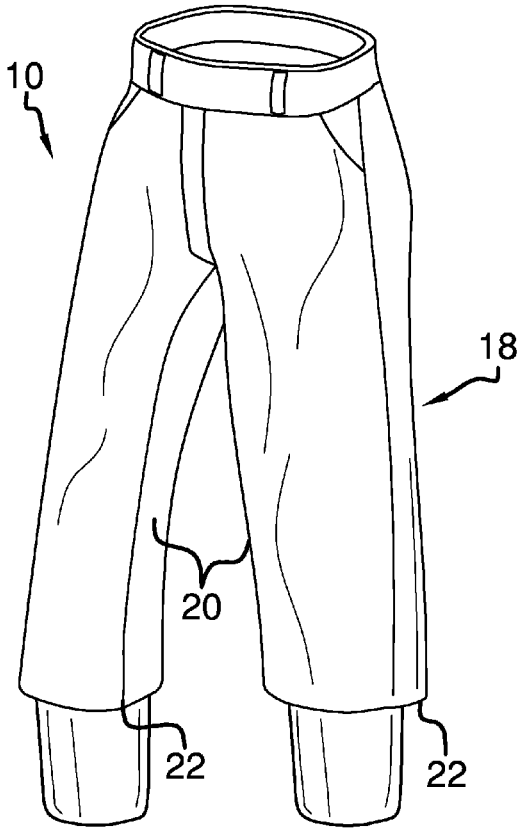
FIG. 1 is a perspective view of a athletic garment assembly according to an embodiment of the disclosure.
Figure 2:
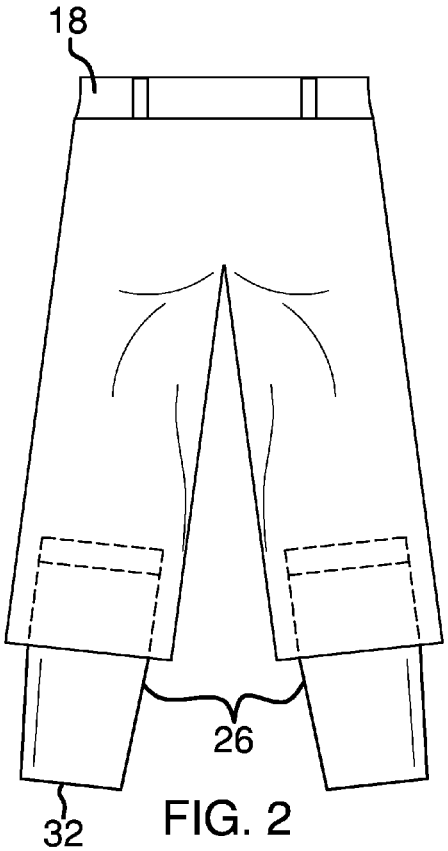
FIG. 2 is a back view of an embodiment of the disclosure.
Figure 3:
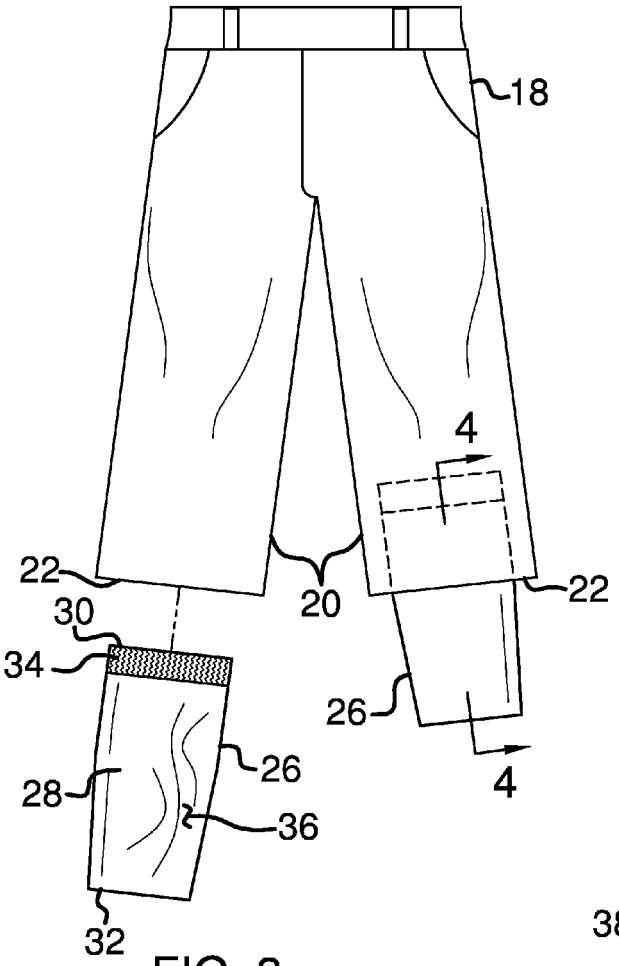
FIG. 3 is a front view of an embodiment of the disclosure.
Figure 4:
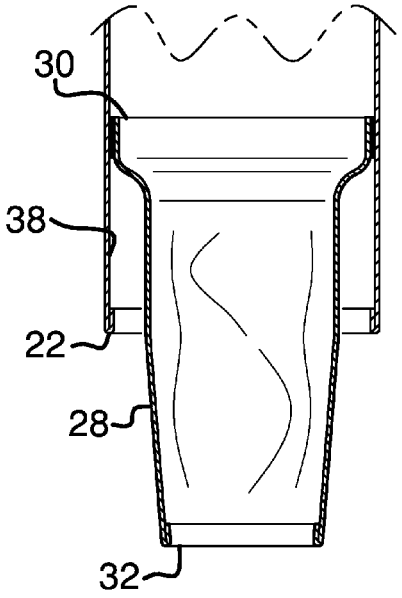
FIG. 4 is a cross sectional view taken along line 4-4 of FIG. 3 of an embodiment of the disclosure.
Figure 5:
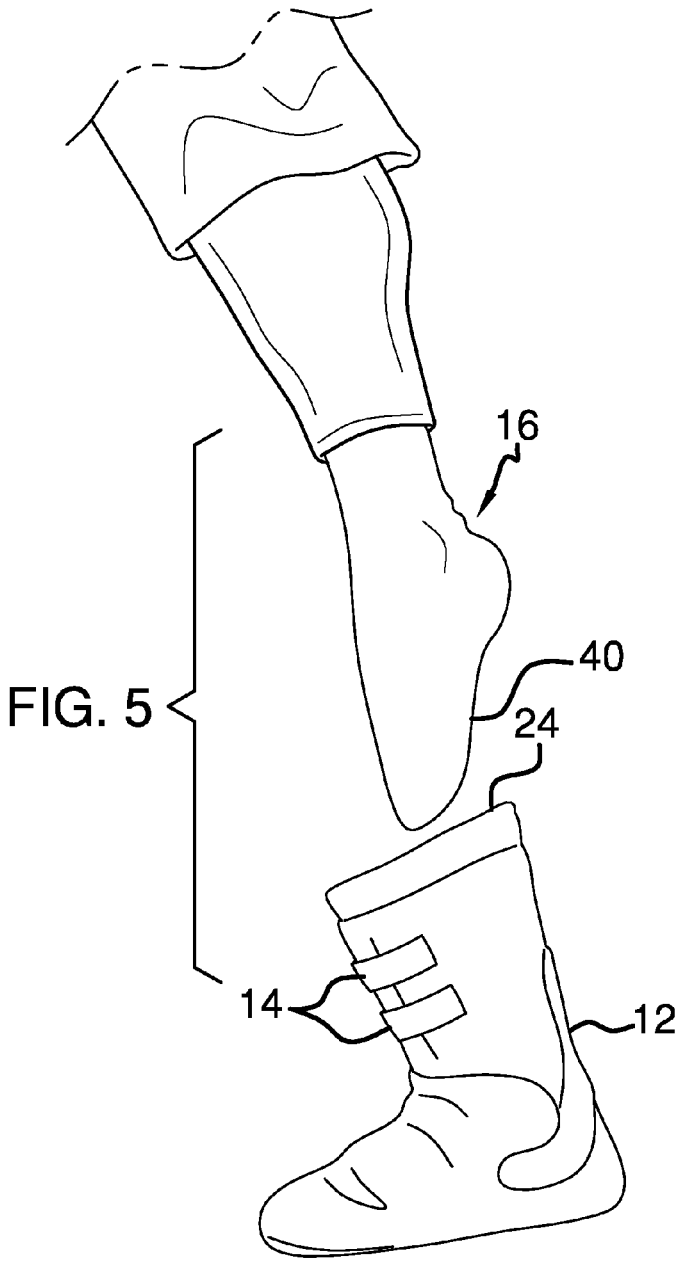
FIG. 5 is an in-use view of an embodiment of the disclosure.

With reference now to the drawings, and in particular to FIGS. 1 through 5 thereof, a new garment device embodying the principles and concepts of an embodiment of the disclosure and generally designated by the reference numeral 10 will be described.

As best illustrated in FIGS. 1 through 5, the athletic garment assembly 10 generally comprises a pair of pants 18. Each of a pair of legs 20 of the pants 18 has a length so a lower end 22 of each of the legs 20 of the pants 18 is positioned proximate a top end 24 of a pair of boots 12 when the pants 18 are worn by the user 16. Additionally, bindings 14 on the boots 12 are accessible when the user 16 wears the pants 18. The pants 18 may be comprised of a fluid impermeable material.

A pair of inserts 26 is provided. Each of the inserts 26 has an outer wall 28 extending between each of a top end 30 and a bottom end 32 of the inserts 26. The top 30 and bottom 32 ends of the inserts 26 are open. The inserts 26 are each substantially hollow. Each of the inserts 26 is positioned within an associated one of the legs 20. Moreover, each of the inserts 26 extends from the lower end 22 of the associated leg 20 to extend into the associated boot 12 when the user 16 wears the pants 18. Alternatively, the inserts 26 may be more permanently attached to the pants 18 such that the inserts 26 are not removable.

A pair of couplers 34 is each coupled to an outer surface 36 of an associated one of the pair of inserts 26. The couplers 34 are positioned proximate the top end 30 of the inserts 26. The couplers 26 extend around an entire circumference of the inserts 26. Moreover, the couplers 34 may each be a hook and loop fastener of any conventional design.

The couplers 34 engage an inner surface 38 of an associated one of a pair of legs 20 of the pants 18. The inserts 26 are removably coupled to the pants 18. The bottom end 32 of the inserts 26 is directed downwardly from the lower end 22 of the legs 20 of the pants 18. Each of the user's feet 40 extends downwardly out of the bottom end 32 of the inserts 26 when the user 16 wears the pants 18. The inserts 26 are positioned within an associated one of the pair of boots 12 so the inserts 26 may prevent moisture from entering the boots 12.

In use, the pants 18 and inserts 26 are worn when the user 16 wishes to engage in snowboarding or downhill skiing. The pants 18 allow the user 16 to access the bindings on the boots 12 while wearing the pants 18. Additionally, the pants 18 do not become entangled in the bindings 14 while the user 16 wears the pants 18.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An athletic garment assembly comprising:

a pair of pants configured to be worn by a user;

each of a pair of legs of said pants having a length such that a lower end of each of said legs is configured to be positioned proximate a top end of an associated one of a pair of boots when said pants are worn by the user wherein bindings on the boots are accessible when the user wears said pants; and a pair of inserts coupled to said pants, each of said pair of inserts being positioned within an associated one of said legs and extending from said lower end of said associated leg wherein said inserts are configured for extending into said pair of boots while said lower ends of said legs is positioned proximate the top end of the associated one of the pair of boots when the user wears said pants, said inserts each having a continuous outer wall being unbroken extending between each of a top end and a bottom end of said insert, said top and bottom ends of said inserts being open, said inserts being substantially hollow.

2. The assembly according to claim 1, further comprising a pair of couplers each coupled to an outer surface of an associated one of said pair of inserts such that said couplers are positioned proximate said top end of said inserts.

3. The assembly according to claim 2, further comprising said couplers engaging an inner surface of an associated one of a pair of legs of said pants such that said bottom end of said inserts is directed downwardly from a lower end of said legs of said pants.

4. The assembly according to claim 3, further comprising each of the user's feet extending downwardly out of said bottom end of said inserts when the user wears said pants such that said inserts are positioned within an associated one of said pair of boots wherein said inserts are configured to prevent moisture from entering said pair of boots.

5. An athletic garment assembly comprising:

a pair of pants configured to be worn by a user, each of a pair of legs of said pants having a length such that a lower end of each of said legs of pants is positioned proximate a top end of an associated one of a pair of boots when said pants are worn by the user wherein bindings on the boots are accessible when the user wears said pants;

a pair of inserts each having an outer wall extending continuously and being unbroken between each of a top end and a bottom end of said inserts, said top and bottom ends of said inserts being open, said inserts being substantially hollow, each of said pair of inserts being positioned within an associated one of said legs and extending from said lower end of said associated leg wherein said inserts are configured for extending into said pair of boots while said lower ends of said legs is positioned proximate the top end of the associated one of the pair of boots when the user wears said pants;

a pair of couplers each coupled to an outer surface of an associated one of said pair of inserts such that said couplers are positioned proximate said top end of said inserts; and said couplers engaging an inner surface of an associated one of a pair of legs of said pants such that said inserts are removably coupled to said pants, said bottom end of said inserts being directed downwardly from said lower end of said legs of said pants, each of the user's feet extending downwardly out of said bottom end of said inserts when the user wears said pants such that said inserts are positioned within an associated one of said pair of boots wherein said inserts are configured to prevent moisture from entering said pair of boots.

* * * * *